US006290812B1

(12) United States Patent
Rampotas et al.

(10) Patent No.: US 6,290,812 B1
(45) Date of Patent: Sep. 18, 2001

(54) METHOD FOR TREATING PROCESS WATER IN CONNECTION WITH PULP BLEACHING

(75) Inventors: Christos Rampotas; Viveka Svensson, both of Helsingborg; Jonny Hansson, Bjuv; Margareta Nilsson, Helsingborg, all of (SE)

(73) Assignee: Kemira Kemi AB, Helsingborg (SE)

( * ) Notice: Subject to any disclaimer, the term of this patent is extended or adjusted under 35 U.S.C. 154(b) by 0 days.

(21) Appl. No.: 09/652,781

(22) Filed: Aug. 31, 2000

Related U.S. Application Data

(63) Continuation of application No. PCT/SE99/00060, filed on Jan. 18, 1999.

(30) Foreign Application Priority Data

Mar. 2, 1998 (SE) ..... 9800645
Oct. 2, 1998 (SE) ..... 9803384

(51) Int. Cl.[7] ..... D21C 11/00

(52) U.S. Cl. ..... 162/29; 162/189; 162/DIG. 8; 210/723; 210/912; 210/928

(58) Field of Search ..... 162/29, 189, 76, 162/DIG. 8; 210/723, 724, 221.1, 221.2, 912, 918

(56) References Cited

U.S. PATENT DOCUMENTS

| | | | |
|---|---|---|---|
| 5,607,549 | 3/1997 | Koskiniemi | 162/30.11 |
| 5,639,347 | 6/1997 | Lindberg | 162/29 |

FOREIGN PATENT DOCUMENTS

| | | |
|---|---|---|
| 1522334 | 1/1993 | (EP) . |
| 1564443 | 10/1993 | (EP) . |
| B098226 | 5/1997 | (FI) . |
| 9300798 | 9/1994 | (SE) . |
| C2-9403779 | 2/1997 | (SE) . |
| 1-9421857 | 9/1994 | (WO) . |
| 1-9423122 | 10/1994 | (WO) . |
| 1-9614467 | 5/1996 | (WO) . |

*Primary Examiner*—Dean T. Nguyen
(74) *Attorney, Agent, or Firm*—Birch, Stewaret, Kolasch & Birch, LLP

(57) ABSTRACT

A method treats process water containing metal ions, in connection with bleaching of lignocellulosic pulp. The method is characterized by the steps of a) adjusting the $Mg^{2+}$ content of the process water to form a flocculating base for metals and an organic substance; b) supplying a carbonate source to the process water to precipiate calcium as calcium carbonate; c) increasing the pH of the process water by adding white liquor to precipipate metals such as metal hydroxides; d) adding a flocculating agent to the process water; and e) separating the precipitated, flocculated metal compounds from the process water by flotation.

11 Claims, 2 Drawing Sheets

METHOD FOR TREATING PROCESS WATER IN CONNECTION WITH PULP BLEACHING

This application is a Continuation of PCT International Application No. PCT/SE99/00060 filed on Jan. 18, 1999, which designated the United States, and on which priority is claimed under 35 U.S.C. §120, the entire contents of which are hereby incorporated by reference.

FIELD OF THE INVENTION

The present invention relates to a method for treating process water. More specifically, it concerns a method for treating process water in connection with bleaching of lignocellulosic pulp.

BACKGROUND OF THE INVENTION

Owing to the increasing interest in environmental matters there is a great wish to reduce the emissions of pollutants from human activities. The pulp and paper producers are considered culprits in this context. In recent years, however, great resources have been used to reduce the emissions caused by our pulp and paper mills, resulting in great progress.

An important goal that has been strived for is to provide the closed pulp mill, that is to say a pulp mill which minimises emissions by regenerating as much as possible existing chemicals in the process and reusing the resulting spent liquors. One stage is to try to return spent bleach liquors counter-currently to the pulp in the process. A problem arising in connection with this procedure is that certain process-foreign substances, for instance ions of transition metals and alkaline earth metals, which are supplied to the process with, for instance, the wood raw material, may be enriched in the system when spent liquors are being returned.

An increasing quantity of the papermaking pulp is today bleached by means of hydrogen peroxide, peracetic acid or ozone. These bleaching processes are disturbed in different ways by present ions of transition metals. One therefore tries as much as possible to complex these ions of transition metals before bleaching. The chemicals currently used as complexing agents are expensive. There is thus a great need for a method, in which these chemicals can be regenerated in an economical manner.

Large amounts of compounds of transition metals and/or alkaline earth metals can separately, or in combination with each other, cause precipitations on the pulp.

With a view to minimising the enrichment of ions of transition metals and alkaline earth metals, a large number of methods have been presented.

SE 504,424 discloses a method for precipitating transition metals and alkaline earth metals from spent bleach liquors by adding an alkaline liquid. In this method, a green and/or white liquor is added to the spent bleach liquor which is then evaporated with the obtained precipitate remaining in the liquor.

WO 94/232122 discloses a further method for treating process water. An alkaline liquid is added to the process water, whereby the metal ions are precipitated, and then the precipitated metal compounds are separated from the process water.

WO 94/21857 discloses one more method for treating spent liquors from bleach plants. Also in this method, an alkaline liquid is added to precipitate metals. The alkaline liquid is first treated with carbon dioxide to reduce the sulphur content and increase the carbonate content thereof.

BRIEF SUMMARY OF THE INVENTION

An object of the present invention is to provide an alternative, efficient method for treating process water from bleach plants in pulp mills, said method being advantageous compared with the methods described above.

Further objects, features and advantages of the present invention will appear from the following description.

The present invention relates to a method for treating process water containing ions of transition metals and alkaline earth metals, in connection with bleaching of lignocellulosic pulp. The method comprises the following steps:

a) adjusting the $Mg^{2+}$ content of the process water to form a flocculation base for metals and an organic substance, b) supplying a carbonate source to the process water to precipitate calcium as calcium carbonate, c) increasing the pH of the process water by adding white liquor to precipitate metals such as metal hydroxides, d) adding a flocculant to the process water, and e) separating the precipitated, flocculated metal compounds from the process water by flotation.

An advantage of the method according to the present invention is that there is no stoichiometric locking between the amount of added carbonate source and the amount of added white liquor, like in WO 94/21857, where the amount of added alkaline solution controls the amount of added carbon dioxide. According to the present invention, the carbonate source and the white liquor are each added separately to the process water which is to be purified, i.e. one amount added does not control the other. A further advantage of the present invention is that the complexing agents are regenerated and are dissolved in the outgoing clarified filtrate which can be returned to the complexing step without further treatment.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Preferred embodiments of the invention will be described below with reference to the accompanying drawings. The drawings must not be considered restrictive to the present invention.

DETAILED DESCRIPTION OF THE INVENTION

Figure 1:
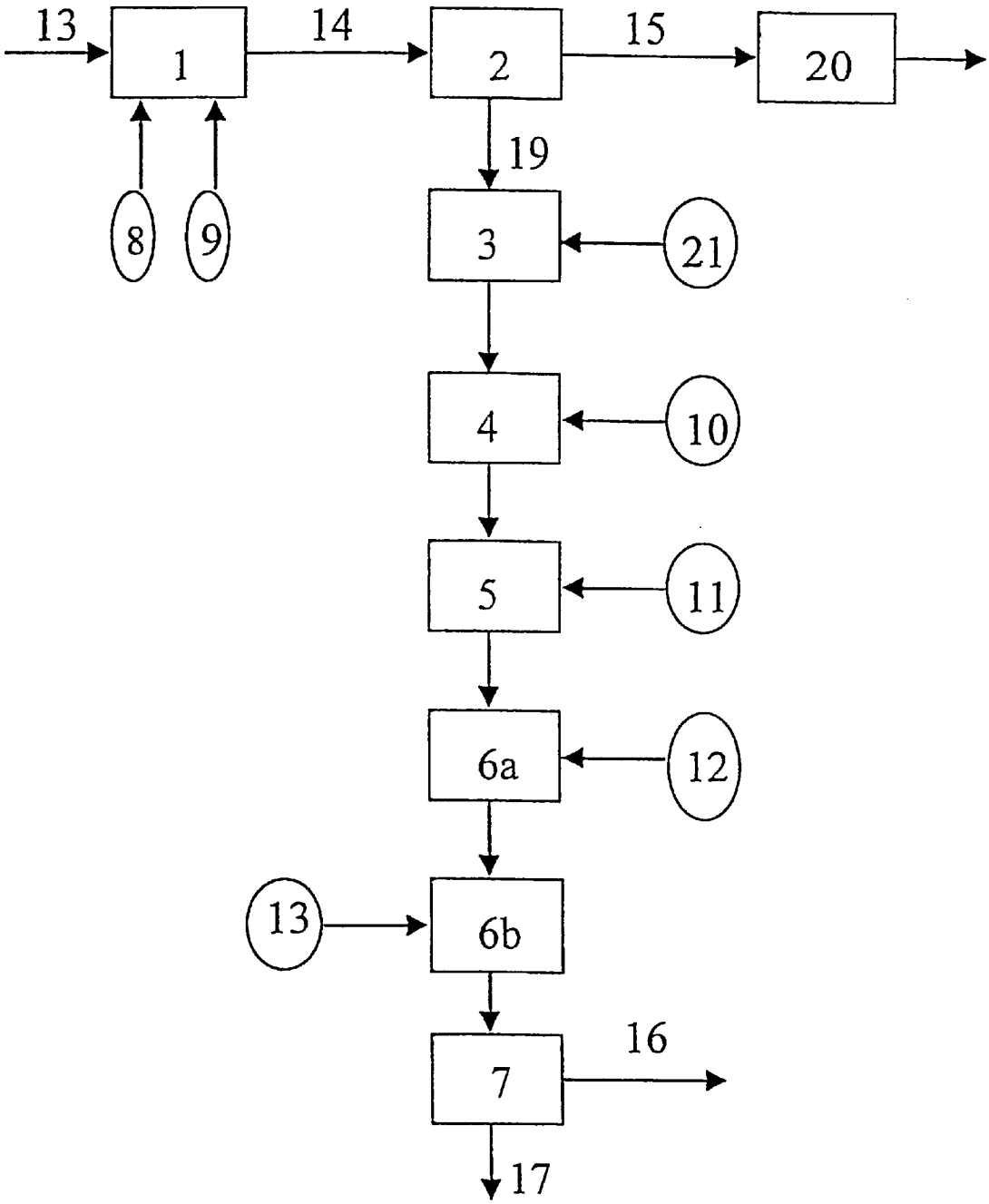
FIG. 1 is a schematic view of a preferred embodiment of a method according to the present invention.

A process water which can be treated according to the present invention originates from a pre-treatment of the papermaking pulp that is to be bleached. This pre-treatment comprises supplying of acid 8 (pH 3–7) and complexing agent 9 to the pulp 13 in step 1 to enable complexing of the transition metals. EDTA and DTPA can be mentioned as examples of complexing agents.

The mixture 14 is then supplied to a filtration step 2, in which the pulp 15 is separated from the process water 19, which now contains various ions of transition metals and alkaline earth metals. Subsequently, the pulp 15 advances to a bleaching step 20 for further treatment. The process water 19 is now further treated according to the present invention.

According to the present invention, the $Mg^{2+}$ content of the process water 19 is adjusted in step 3 to form a flocculating base for metals and an organic substance. In this manner, the various solids are more easily flocculated than in the case where the $Mg^{2+}$ content is not adjusted. The $Mg^{2+}$ content is preferably adjusted to at least 15 ppm and 400 ppm at most. The adjustment is preferably carried out by adding $MgSO_4$, $MgCl_2$ and/or MgO 21 to the process water 19. In the adjustment of the $Mg^{2+}$ content, the pH should preferably be lower than 9, but the adjustment can also be carried out after increasing the pH of the process water. Subsequently, a carbonate source 10 is supplied to the process water in step 4 to precipitate calcium ions as calcium carbonate. The carbonate source 10 is preferably selected among water-free $Na_2CO_3$, which is called soda, $Na_2CO_3$ crystallised from green liquor, a filter cake containing carbonate and originating from dust produced by a soda recovery boiler, and gas containing carbon dioxide.

By the expression "$Na_2CO_3$ crystallised from green liquor" is meant $Na_2CO_3$ which can be obtained, for instance, in the manner disclosed in U.S. Pat. No. 5,607,549 and FI 98226-C.

By the expression "a filter cake containing carbonate and originating from dust produced by a soda recovery boiler" is meant a filter cake which is obtained in separation of dust after combustion in a soda recovery boiler. The filter cake formed in the separation of dust after a soda recovery boiler is, among other things, rich in carbonate and can be used as a carbonate source in the method according to the present invention.

Gas containing carbon dioxide is a product which is easily accessible and which can be obtained on the one hand by combustion in the pulp process in its entirety and, on the other hand, as a commercial product. Examples of gases containing carbon dioxide are pure carbon dioxide, flue gases from, for instance, a soda recovery boiler, lime sludge returning kiln or bark burning boiler. When a gas containing carbon dioxide is used as carbonate source, it is preferred to first add white liquor to the process water and then to add the gas containing carbon dioxide since the absorption of carbon dioxide in the process water increases as the pH increases.

The amount of added carbonate source 10 is controlled by the calcium ion concentration in the filtrate, and preferably the mole ratio $Na_2CO_3/Ca^{2+}$ is 0.5–3.

Then white liquor 11 is added to the process water in step 5 to increase the pH thereof and to precipitate the metals as, for instance, metal hydroxides. The pH is increased preferably to about 8–13, more preferred 10–11 measured at the process temperature which usually is about 60–85° C.

By the expression white liquor is meant digestion liquid to produce sulphate pulp containing about 10% sodium hydroxide and traces of sodium carbonate. The white liquor, which is used in the method according to the present invention, is preferably oxidised and has preferably been purified in respect of transition metals and/or alkaline earth metals.

In step 6, a flocculating agent (12, 13) is added, which in a preferred embodiment of the present invention is carried out by first adding in step 6*a* a compound selected among phenolic resin; lignin derivative such as lignosulphonate; naphthalene sulphonate; and formaldehyde condensate of sulphonyldihydroxy benzene, preferably in an amount of 2.5–100 ppm, the added compound being designated 12, whereupon a polymer 13 is added to the process water in step 6*b*. The polymer is preferably added in an amount of 0.5–25 ppm. Examples of suitable polymers are polyethylene oxide and polyacrylamide.

The flocculating agent (12, 13) acts to flocculate the precipitated particles, and during flotation (here designated 7) the flocculated particles 16 rise towards the surface and can be separated from the resulting clarified filtrate 17.

Figure 2:
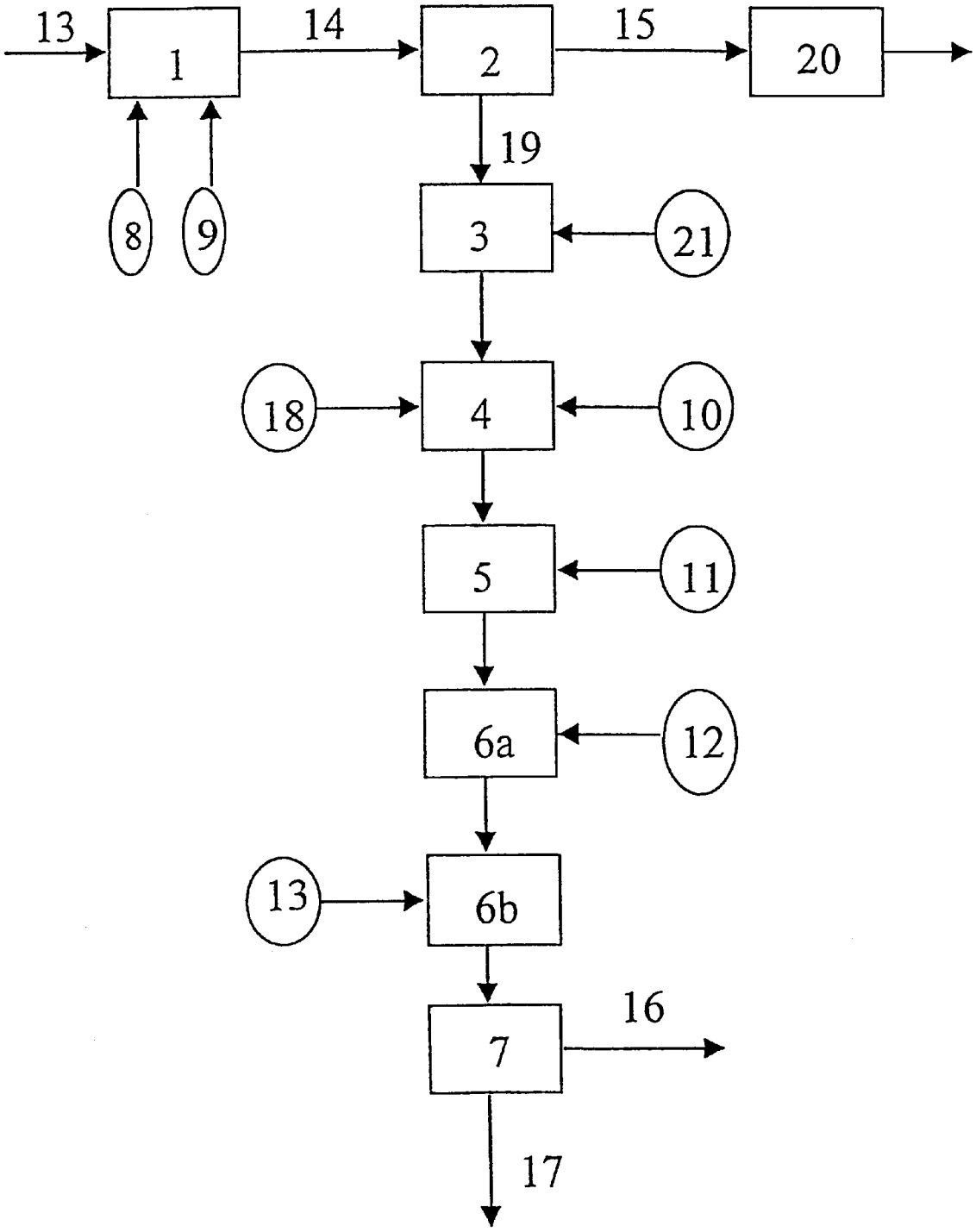
FIG. 2 is a schematic view of a further preferred embodiment of a method according the invention.

In a further preferred embodiment of the present invention as shown in FIG. 2, air or some other gas 18 is supplied while at the same time a carbonate source 10, for instance $Na_2CO_3$, is supplied to the process water (i.e. in step 4). The process water usually contains large amount of gas bubbles even after the filtration step 2, but by adding the gas 18 and also in the case where the carbonate source 10 is gas containing carbon dioxide, the advantage of the flotation step 7 taking a shorter time is achieved.

In a preferred embodiment of the present invention, thus no supply of gas in flotation 7 is required, which normally is the case, but the flotation 7 can be carried out with the existing gas in the process water.

The resulting clarified filtrate 17 contains chemicals for complexing and can be returned counter-currently in the process in step 1 or in other steps in the process. The resulting sludge of flocculated particles 16 can then be dewatered, whereupon the residues are deposited.

There are several advantages of the present invention, inter alia, there is, as mentioned above, no stoichiometric locking between the amount of added carbonate source 10 and the amount of added white liquor 11.

The inventive method further yields good conditions for regenerating the expensive complexing agents which are dissolved in the outgoing clarified filtrate 17.

The inventive method further yields good reduction of extractive substances, such as fatty acids and colopholic acids, as well as COD and other organic compounds.

The clarified filtrate 17 forming in the inventive method is also very advantageous for use as washing liquid. The clarified filtrate 17 contains a clearly reduced amount of air since it has undergone a flotation process 7, in which deaeration takes place. A clarified filtrate 17 which is largely deaerated, gives a better effect than a clarified filtrate 17 containing air when washing since the presence of air deteriorates the washing effect. Moreover, the absence of air in the clarified filtrate 17 gives the advantage that the need for anti-foaming agents in connection with filtration decreases. The smaller amount of air present in filtration, the smaller amount of froth forms in the filtrate.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for treating process water containing metal ions, in connection with bleaching of lignocellulosic pulp, comprising the sequential steps of:

a) adjusting the $Mg^{2+}$ content of the process water to form a flocculation base for metals and an organic substance by adding $Mg^{2+}$, b) supplying a carbonate source to the process water to precipitate calcium as calcium carbonate, c) increasing the pH of the process water by adding white liquor to precipitate metals, d) adding a flocculant to the process water, and e) separating the precipitated, flocculated metal compounds from the process water by flotation.

2. The method as claimed in claim 1, wherein the carbonate source in step b) is selected among water-free $Na_2CO_3$, $Na_2CO_3$ crystalised from green liquor, a filter cake containing carbonate and originating from dust produced by a soda recovery boiler, and gas containing carbon dioxide.

3. The method as claimed in claim 1, wherein step d) comprises a first addition of a compound selected among phenolic resin, lignin derivative, naphthalene sulphonate, and formaldehyde condensate of sulphonyldihydroxy benzene, and a second addition of a polymer.

4. The method as claimed in claim 3, wherein polyethylene oxide and/or polyacrylamide are added as polymers in step d).

5. The method as claimed in claim 1, further comprising the steps of adjusting the $Mg^{2+}$ content to at least 15 ppm in step a).

6. The method as claimed in claim 5, further comprising the step of adjusting the $MG^{2+}$ content by adding $MgSO_4$, $MgCl_2$ and/or MgO.

7. The method as claimed in claim 1, further comprising the step of adding the carbonate source in step b) to the process water so that the mole ratio $Na_2CO_3/Ca^{2+}$ is at least 0.5.

8. The method as claimed in claim 1, further comprising the step of increasing the pH of the process water to 8–13.

9. The method as claimed in claim 1, further comprising the step of carrying out the flotation by existing gas in the process water.

10. The method as claimed in claim 1, further comprising the step of supplying a gas to the process water in step b).

11. The method as claimed in claim 1, further comprising the step of increasing the pH of the process water to 10–11 in step c).

* * * * *